US007724273B2

(12) United States Patent
Koyabu

(10) Patent No.: US 7,724,273 B2
(45) Date of Patent: May 25, 2010

(54) THERMAL PRINTER

(75) Inventor: Akira Koyabu, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 12/342,366

(22) Filed: Dec. 23, 2008

(65) Prior Publication Data

US 2009/0185022 A1 Jul. 23, 2009

(30) Foreign Application Priority Data

Jan. 18, 2008 (JP) ..... 2008-008812

(51) Int. Cl.
*B41J 2/32* (2006.01)
*B41J 29/17* (2006.01)

(52) U.S. Cl. ..... 347/171; 400/701

(58) Field of Classification Search ..... 347/171, 347/197; 400/120.16, 701
See application file for complete search history.

(56) References Cited

U.S. PATENT DOCUMENTS 6,325,485 B2 * 12/2001 Xu et al. ..... 347/33
6,367,904 B1 * 4/2002 Xu et al. ..... 347/33
6,517,186 B1 * 2/2003 Wolf et al. ..... 347/33
2002/0106229 A1 * 8/2002 Meier et al. ..... 400/701

FOREIGN PATENT DOCUMENTS

| | | |
|---|---|---|
| JP | 05-338223 | 12/1993 |
| JP | 2000-246934 | 9/2000 |
| JP | 2004-167751 | 6/2004 |

* cited by examiner

*Primary Examiner*—Huan H Tran

(57) ABSTRACT

Accumulation of foreign matter on the surface of the thermal head that can cause printing defects can be reliably prevented. The downstream edge 54*a* of the surface 52 of the thermal head 5 is substantially flush with the downstream end of the paper nipping area C of the thermal head 5 and the platen roller 8 in the thermal printer 1. The downstream end 54 extending from the downstream edge 54*a* in a direction perpendicular to the back side is connected to a through-hole 66 (foreign matter receptacle) formed in the heat sink 6. Foreign matter on liner-less label paper 11 clings to the downstream end 54 of the thermal head 5 after passing the paper nipping area C, and is then fed along the downstream end 54 into the through-hole 66 on the back. Foreign matter does not accumulate on the surface 52 of the thermal head 5, and problems such as streaking and other printing defects caused by foreign matter on the surface 52 of the thermal head 5 do not occur.

9 Claims, 7 Drawing Sheets

(B-B SECTION)

THERMAL PRINTER

CROSS-REFERENCE TO RELATED APPLICATIONS

This application claims priority under 35 U.S.C. §119 to Japanese Patent Application No. 2008-008812 filed on Jan. 18, 2008, the entire disclosure of which is expressly incorporated by reference herein.

BACKGROUND

1. Field of Invention

The present invention relates generally to a thermal printer that conveys and prints while pressing the recording medium against a thermal head by means of a platen roller, and relates more particularly to a thermal printer that can prevent foreign matter from adhering and accumulating on the surface of the thermal head in conjunction with conveying the recording medium.

2. Description of Related Art

Thermal heads used in thermal printers generally have heating elements disposed along the printing width on the surface of a ceramic substrate. The ceramic substrate is typically affixed to a metal heat sink and disposed to the printer frame. A platen roller presses against the surface of the thermal head with the recording medium (thermal paper) disposed therebetween. When the platen roller is then turned, the recording medium is conveyed while pressed against the heating elements of the thermal head, and content is printed on the surface of the recording medium.

Paper dust, chaff, and other foreign matter may be on the surface of the recording medium, and this foreign matter may transfer and stick to the surface of the thermal head as the recording medium is conveyed pressed and rubbing against the surface of the thermal head. The color-producing coating on the surface of the recording medium may also rub off and stick to the surface of the thermal head.

When printing to liner-less label paper wound in a roll (that is, label paper that has adhesive applied to the back side and is wound in a roll without a backing liner, similarly to cellophane tape), the adhesive may also transfer and adhere to the front printing side of the paper, and the adhesive may transfer from there to the surface of the thermal head.

Such foreign matter tends to accumulate in an area downstream in the recording medium transportation direction from where the platen roller and thermal head nip the paper (the "nipping area" below). When such foreign matter builds up, the thermal head presses against the surface of the recording medium with the foreign matter therebetween, resulting in insufficient contact with the recording medium, insufficient transfer of heat, and thus print defects such as streaking.

Soiling of the surface of the thermal head is commonly removed by regularly passing a special cleaning sheet between the thermal head and the platen roller. As taught in Japanese Unexamined Patent Appl. Pub. JP-A-2004-167751, a polishing function may also be imparted by impregnating the outside surface of the platen roller with an abrasive agent so that foreign matter on the surface of the thermal head is removed by the platen roller rotating while pressed directly against the surface of the thermal head.

SUMMARY OF INVENTION

A thermal printer according to at least one embodiment of the present invention features a novel innovation preventing foreign matter from accumulating on the surface of the thermal head so that frequently cleaning the thermal head is not necessary.

A first aspect of the invention is a thermal printer having a thermal head; a mounting member to which the thermal head is disposed; a platen roller for conveying while pressing a recording medium against the thermal head; and a foreign matter receptacle formed receding from the thermal head mounting surface of the mounting member on the downstream side in the recording medium transportation direction from the nipping area formed between the thermal head and the platen roller.

The place where foreign matter adheres and accumulates on the surface of the thermal head is downstream from the nipping area of the platen roller and thermal head. At least one embodiment of the invention forms a foreign matter receptacle receding from the thermal head mounting surface of the mounting member on the downstream side of the nipping area. Foreign matter therefore does not accumulate on the surface of the thermal head, and is carried to and collected in the foreign matter receptacle downstream therefrom. By assuring sufficient capacity in the foreign matter receptacle, foreign matter can be prevented from accumulating in the foreign matter receptacle and eventually protruding to the platen roller side from the surface of the thermal head. Problems caused by foreign matter accumulating on the surface of the thermal head preventing the recording medium from being pressed with sufficient pressure against the heating unit of the thermal head, resulting in streaks or other printing defects, can therefore be prevented.

The nipping area is greater than the width in the recording medium transportation direction of a heating unit disposed to the thermal head.

Because the nipping area where the platen roller applies pressure to the recording medium is wider in the recording medium transportation direction than the heating unit of the thermal head, carrying foreign matter downstream from the heating unit is promoted and accumulation of foreign matter at the heating unit can be prevented.

Further preferably, the downstream end of the thermal head in the recording medium transportation direction is substantially flush with the downstream end of the recording medium nipping area.

If the surface of the thermal head ends at the downstream end of the recording medium nipping area, foreign matter clinging to the recording medium cannot pass the recording medium nipping area and then adhere to the front surface of the thermal head, and instead is carried in the direction receding from the front surface along the downstream end surface that extends in the direction receding from the downstream end. Foreign matter can thus be reliably prevented from becoming trapped between the recording medium and the surface of the thermal head.

The thermal head is generally attached to a mounting member such as a metal heat sink. The foreign matter receptacle may be rendered in the mounting member proximally to the downstream end of the thermal head.

In this configuration the foreign matter receptacle is preferably a through-hole or recessed part extending widthwise to the recording medium. By assuring sufficient capacity in the foreign matter receptacle thus formed, foreign matter can be prevented from accumulating in the foreign matter receptacle and eventually protruding to the platen roller side from the surface of the thermal head.

Further preferably, the side of the through-hole or recessed part on the upstream side in the recording medium transportation direction is positioned on an extension of the downstream end of the thermal head. This facilitates foreign matter carried along the downstream end of the thermal head being fed quickly into the through-hole or recessed part.

Further preferably, the mounting member has a guide surface for guiding the platen roller. The guide surface formed at a position downstream in the recording medium transportation direction from the through-hole or recessed part and inclining in the direction receding from the front surface to the downstream side in the recording medium transportation direction.

When the thermal head is disposed to the printer frame, the platen roller is disposed to a cover that is attached to open and close to the printer frame, and the cover is closed, the platen roller moves from the end and along the surface of the thermal head while being pressed against the surface, and is set with the heating unit positioned in the center of the nipping area. When a guide surface is provided, the platen roller is guided by the guide surface when the cover closes, and is prevented from colliding with the end of the thermal head. As a result, the cover can be closed with a smoother operation, and problems such as damage to the part of the recording medium pinched between the platen roller and the end of the thermal head can be prevented.

Further preferably, grooves are formed from the front to the back of the thermal head on at least one of the downstream end of the thermal head and the upstream side of the through-hole or recessed part in the recording medium transportation direction.

These grooves make it easier for adhesive or other foreign matter that transfers from the recording medium to the downstream end of the front surface of the thermal head or the downstream-side end surface to move through the grooves to the back. Accumulation of foreign matter at parts on the downstream end of the front surface of the thermal head can therefore be reliably prevented.

Instead of or in addition to forming grooves, a thermal printer according to another aspect of the invention preferably has a coating applied to at least one of the downstream end of the thermal head and the upstream side of the through-hole or recessed part in the recording medium transportation direction.

By applying a coating to the downstream-side end surface, foreign matter can easily move along the downstream-side end surface to the back, and accumulation of foreign matter on the downstream-side end surface can be reliably prevented.

A thermal printer according to a preferred aspect of the invention has a foreign matter receptacle formed receding from the front printing surface of the thermal head at a position proximal to the downstream side at the downstream end of the recording medium nipping area of the thermal head and platen roller. Therefore, foreign matter that transfers from the recording medium to the thermal head side at the downstream end of the recording medium nipping area does not cling to the front surface of the thermal head and instead is received into and accumulates in a receding foreign matter receptacle receding. Accumulation of foreign matter on the front printing surface of the thermal head can therefore be reliably prevented, and problems such as printing defects caused by accumulated foreign matter can be prevented.

Other objects and attainments together with a fuller understanding of the invention will become apparent and appreciated by referring to the following description and claims taken in conjunction with the accompanying drawings.

DESCRIPTION OF THE PREFERRED EMBODIMENTS

A preferred embodiment of a thermal printer according to at least one embodiment of the present invention is described below with reference to the accompanying figures.

General Configuration

Figure 1:
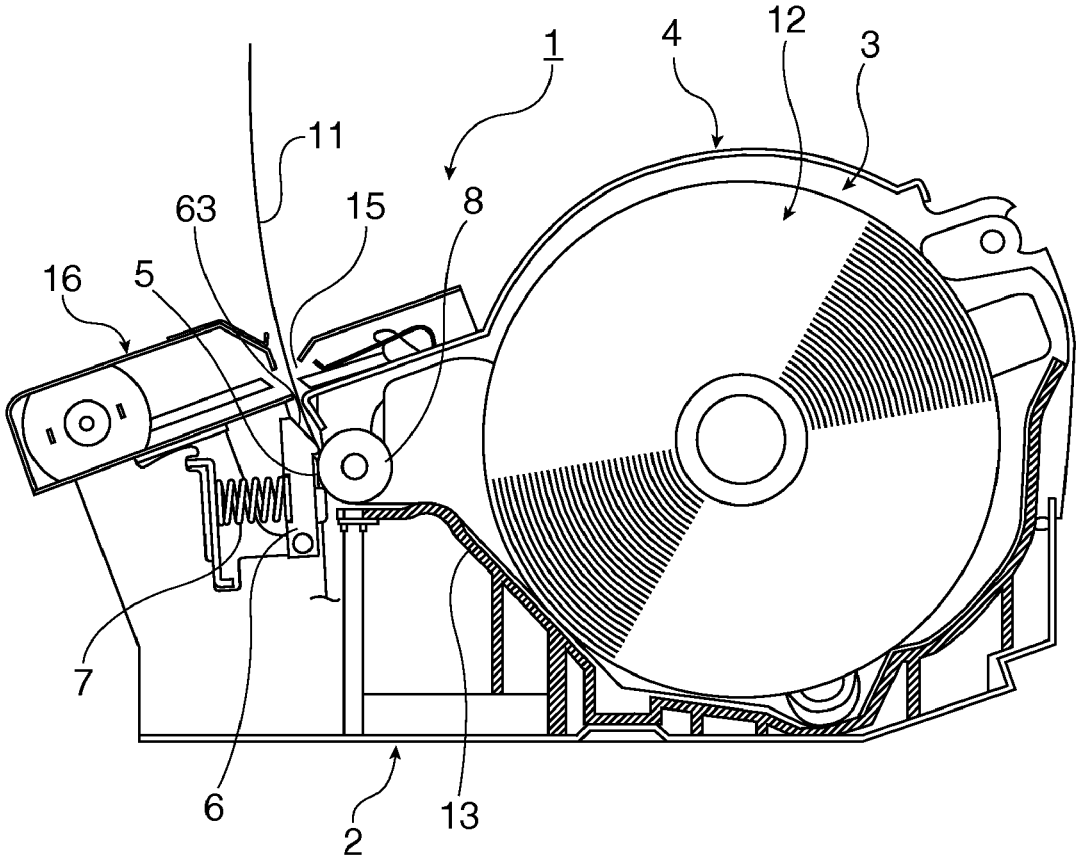
FIG. 1 is a schematic section view showing the mechanical part of a thermal printer according to a preferred embodiment of the invention.
Figure 2:
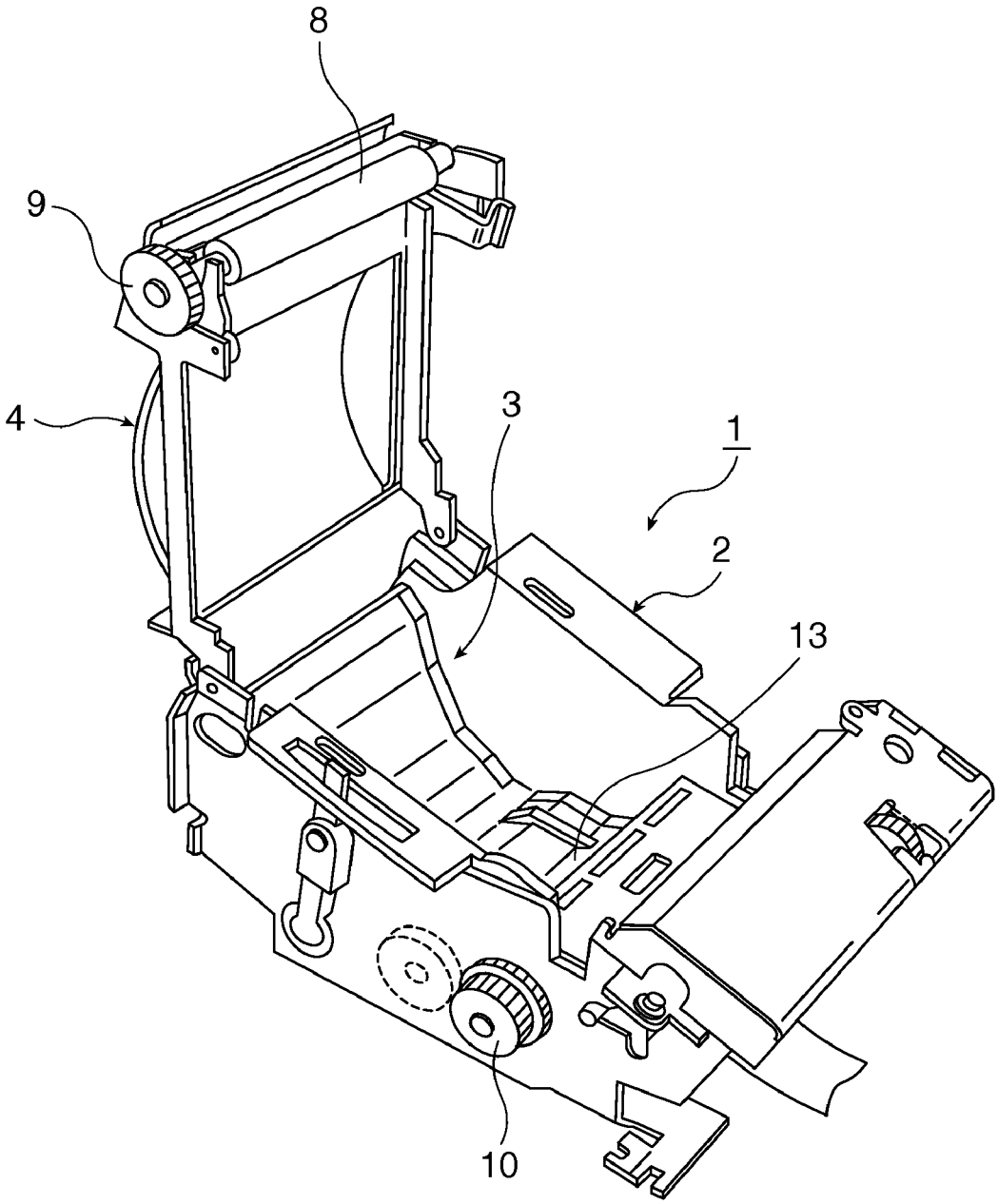
FIG. 2 is a schematic oblique view showing the mechanical part of the thermal printer when the cover is open.

FIG. 1 is a schematic section view showing the mechanical part of a thermal printer according to a preferred embodiment of the invention. FIG. 2 is a schematic oblique view showing the mechanical part of the thermal printer when the cover is open. As shown in these figures, the thermal printer 1 has a sheet metal printer frame 2, and a roll paper compartment 3 that is open at the top is formed inside this printer frame 2. The opening to the roll paper compartment 3 is closed by a cover 4, which pivots up and down to open and close on a pivot axis at the back end of the printer. The thermal head 5 is disposed substantially vertically facing the back of the printer (facing the inside) at a position at the front of the roll paper compartment 3 in the printer frame 2. The thermal head 5 is affixed to a metal heat sink 6, and the heat sink 6 is disposed to the printer frame 2 so that the heat sink 6 can rock at the bottom end thereof in the front-back direction of the printer. The heat sink 6 is urged by a coil spring 7 from the back side of the heat sink 6, that is, from the front side of the printer.

A platen roller 8 mounted at the distal end part of the cover 4 is pressed against the thermal head 5 from the side towards the back of the printer. A follower gear 9 attached to the end of the platen roller 8 shaft meshes with a drive gear 10 disposed on the printer frame 2 side. The drive gear 10 is driven rotationally by a paper feed motor not shown.

Roll paper 12 (not shown in FIG. 2) is loaded in the roll paper compartment 3. In this embodiment of at least one embodiment of the invention the roll paper 12 is linerless label paper 11 similar to cellophane tape wound into a roll. The linerless label paper 11 delivered from the roll paper 12 is pulled along the recording medium guide 13, passes between the paper nipping area of the thermal head 5 and platen roller 8, and is threaded leading up and out from the paper exit 15 downstream from the thermal head 5 and platen roller 8. A scissors-type automatic paper cutter 16 for cutting across the printing width of the linerless label paper 11 is disposed at the paper exit 15.

When the cover 4 is closed from the open position, the platen roller 8 disposed to the end thereof contacts the guide surface 63 on the top of the heat sink 6, is guided by the guide surface 63, and goes to the closed position pressed against the surface of the thermal head 5 with the linerless label paper 11 therebetween while pushing the heat sink 6 in opposition to the pressure applied by the coil spring 7. As indicated by the dotted lines in FIG. 2, the follower gear 9 of the platen roller 8 meshes with the drive gear 10 and the platen roller 8 can thus be driven rotationally. The cover 4 is rocked by a rocking mechanism.

Thermal Head and Heat Sink

Figure 3A:
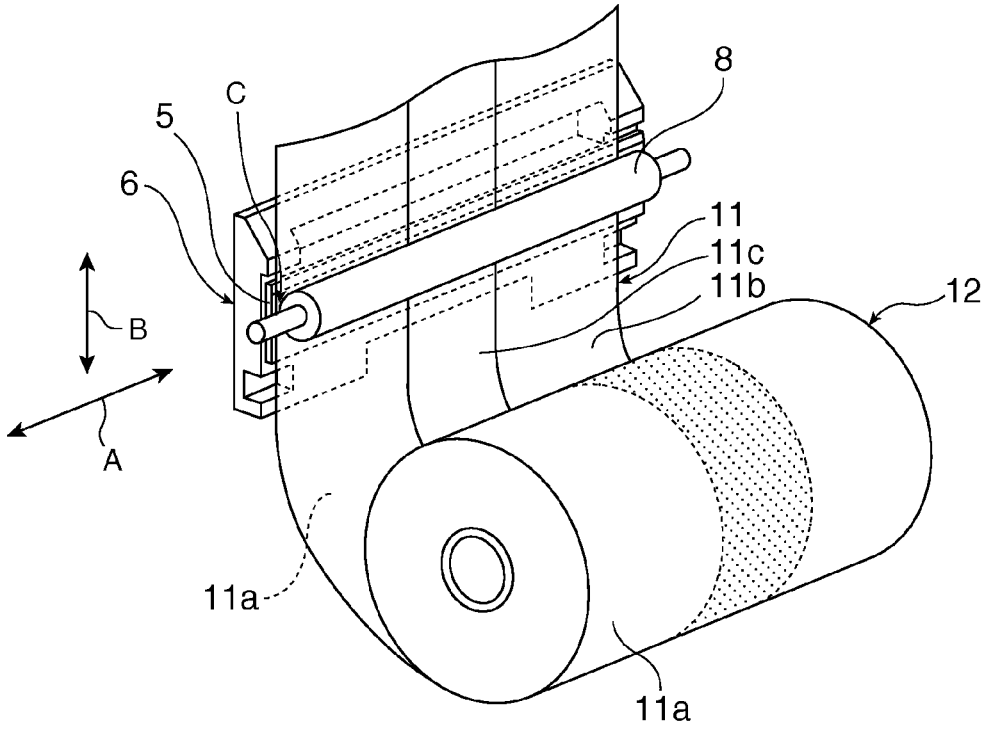
FIG. 3 describes the thermal head, heat sink, and platen roller.
Figure 3B:
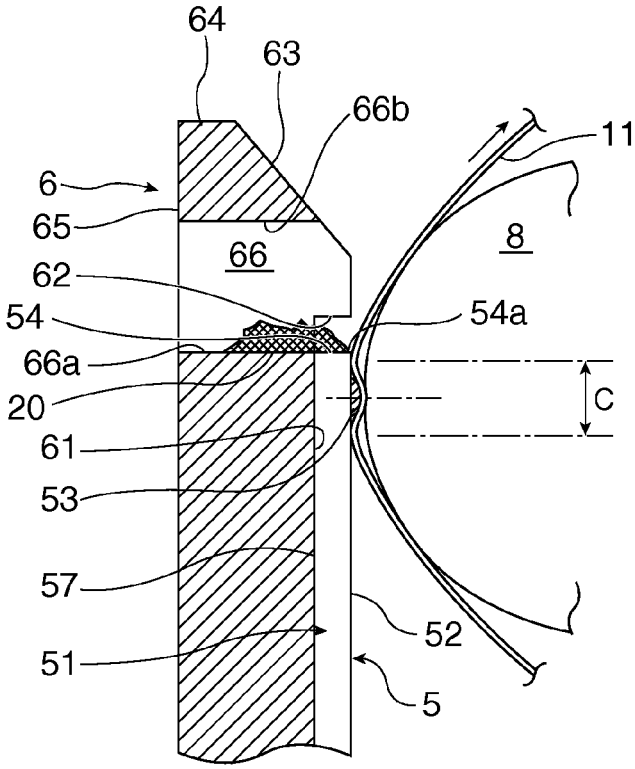
Figure 4A:
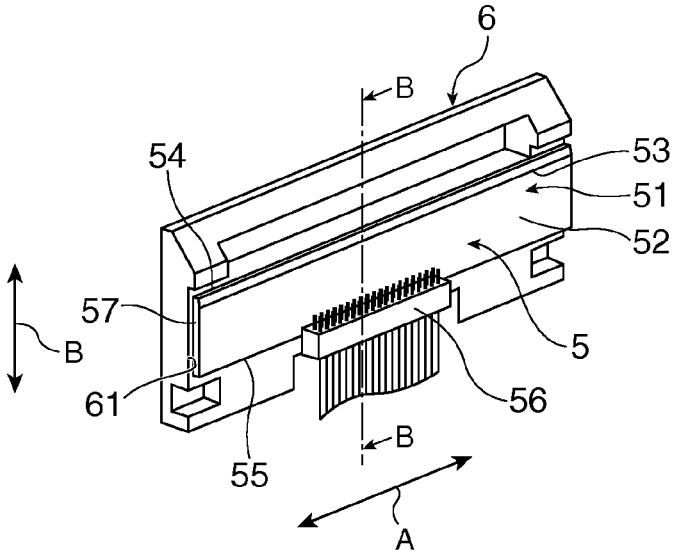
FIG. 4 is an oblique view and partial section view showing the thermal head and the heat sink.

FIG. 3A describes the thermal head 5, the heat sink 6, and the platen roller 8, and FIG. 3B is a partial section view of the same. FIG. 4A is an oblique view of the thermal head 5 and the heat sink 6, and FIG. 4B and FIG. 4C are partial section views showing two examples of the shape of the heat sink 6 seen in section.

The thermal head 5 is a line thermal head, and has a substrate with a constant thickness and a long, narrow rectangular shape aligned with the printing width direction A, such as a ceramic substrate 51, and a heating unit 53 composed of numerous heating elements arrayed at a constant pitch in the printing width direction on the surface 52 of the substrate 51. The heating unit 53 is disposed to the surface 52 of the substrate 51 on the side near the downstream end 54 in the paper transportation direction B. A connector 56 for supplying power and signals, for example, to the heating unit 53 is disposed in the middle part of the substrate 51 on the upstream end 55 in paper transportation direction B, and a flexible printed circuit extends from this connector 56.

The heat sink 6 is made from a metal plate, such as aluminum, that is slightly longer than the thermal head 5 in the printing width direction A. A flat print head installation surface 61 is formed on the front of the heat sink 6, and the back 57 of the thermal head 5 is bonded to this print head installation surface 61. A shoulder 62 projecting perpendicularly is formed at the downstream end of the print head installation surface 61 in the paper transportation direction B, and the guide surface 63 continues from the distal end of the shoulder 62. The guide surface 63 inclines from the end of the shoulder 62 toward the back 65 to the downstream end 64 of the heat sink 6. The shoulder 62 protrudes an amount substantially equal to the thickness of the thermal head 5.

Figure 4B:
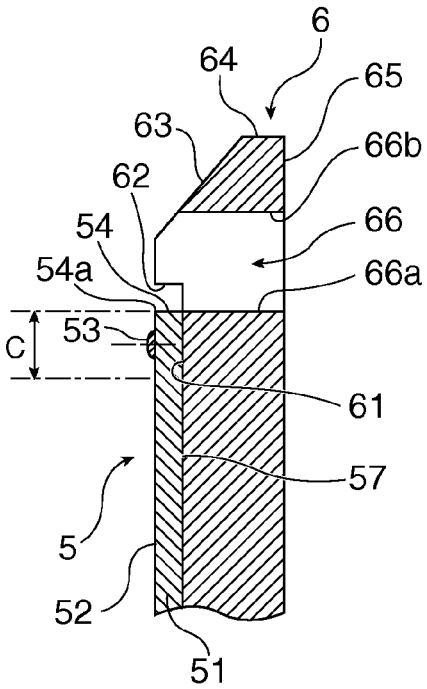
Figure 4C:
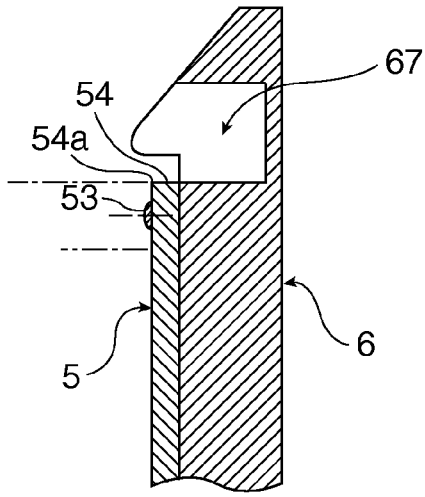

As shown in FIG. 3B and FIG. 4B, a through-hole 66 that functions as a foreign matter receptacle is formed in the heat sink 6. This through-hole 66 passes from the front to the back of the heat sink 6. The through-hole 66 is a long narrow rectangular hole of a constant width extending in the printing width direction A, and has a length corresponding to the maximum printing width of the thermal head 6 or the width of the thermal head 5.

The surface 66*a* defining the through-hole 66 on the upstream side in the paper transportation direction is positioned substantially on the same plane (an extension of the downstream end) as the downstream end 54 of the thermal head 5. In this embodiment of at least one embodiment of the invention the downstream end 54 recedes perpendicularly from the downstream edge 54*a* of the surface 52, and the upstream side surface 66*a* that is positioned substantially on the same plane as the downstream end 54 extends perpendicularly to the print head installation surface 61 and the back 65. The downstream side surface 66*b* of the through-hole 66 opposite the upstream side surface 66*a* extends parallel to the side surface 66*a* from a position between the ends of the guide surface 63. This through-hole 66 enables foreign matter accumulating therein to move from the front to the back side of the heat sink 6 so that it does not accumulate and clog the through-hole 66.

The downstream end 54 may also recede in a different direction from the surface 52 than perpendicularly. For example, the downstream end 54 may be a slope that inclines downstream in the paper transportation direction B, or the downstream end 54 may conversely may be a slope that inclines upstream in the paper transportation direction B. An incline of a particular angle can promote movement of the foreign matter.

Instead of a through-hole 66, the foreign matter receptacle may alternatively be a recessed part 67 rectangular in section as shown in FIG. 4C. This recessed part 67 is a long narrow rectangular channel extending in the printing width direction A with a predetermined depth rendered from the surface toward the back side of the heat sink 6 and a length in the printing width direction corresponding to the maximum printing width of the thermal head 5 or the width of the thermal head 5. In this configuration the recessed part 67 is formed at a position adjacent to the downstream end 54 of the thermal head 5. Using a recessed part 67 that does not pass all the way through the heat sink 6 affords more volume in the heat sink 6 and can thus improve dissipation of heat from the thermal head 5.

The foreign matter receptacle may also be a through-hole or recess with a different shape in section than described above. In all configurations, however, the capacity of the foreign matter receptacle must be sufficient to receive the foreign matter that gathers on the downstream side of the paper nipping area C.

As shown in FIG. 3B and FIG. 4B, the downstream edge 54*a* of the surface 52 of the thermal head 5 is substantially coincident to the downstream end of the paper nipping area C of the thermal head 5 and platen roller 8. The heating unit 53 is also positioned in the paper nipping area C substantially centered to the paper transportation direction B. The width of the paper nipping area C in the paper transportation direction B varies according to such parameters as the pressure applied by the spring member, and the outside diameter and the hardness of the outside surface of the platen roller 8, and in this embodiment of at least one embodiment of the invention is approximately 2 mm, for example.

EFFECT OF THE INVENTION

As shown in FIG. 3A, an adhesive area 11*c* to which adhesive is disposed is exposed on the back 11*b* of the linerless label paper 11. When the linerless label paper 11 is wound into a roll forming the roll paper 12, the front 11*a* (printing side) of the linerless label paper 11 is wound in contact with the adhesive area 11*c* of the back 11*b*, which is on the outside of the linerless label paper 11 when wound into a roll. When the linerless label paper 11 is pulled from the roll paper 12, adhesive in the adhesive area 11*c* may be transferred and stick to the front 11*a*. When the linerless label paper 11 is then conveyed with adhesive on the front 11*a* through the paper nipping area C of the thermal head 5 and platen roller 8, the adhesive on the front 11*a* of the linerless label paper 11 rubs against and may adhere to the thermal head 5 as the paper is conveyed from the upstream side to the downstream side of the paper nipping area C. Paper dust, chaff, and other foreign matter on the front 11*a* of the linerless label paper 11 may also cling to the thermal head 5 as the paper is conveyed from the upstream side to the downstream side of the paper nipping area C.

With the thermal head 5 according to this embodiment of at least one embodiment of the invention, however, the downstream edge 54*a* of the surface 52 is substantially flush with the downstream end of the paper nipping area C. Foreign matter on the front 11*a* of the linerless label paper 11 therefore sticks to the downstream end 54 side continuous to the downstream edge 54*a* after passing the downstream end of the paper nipping area C instead of sticking to the surface 52 of the thermal head 5.

A through-hole 66 is rendered as a foreign matter receptacle on the back side of the downstream end 54. Therefore, as shown in FIG. 3B, any foreign matter 20 clinging to the downstream end 54 gradually moves along this surface and enters the through-hole 66, and is gradually pushed from the front to the back side. As a result, problems such as printing streaks and other printing problems caused by foreign matter 20 accumulating on the surface 52 of the thermal head 5 so that there is insufficient contact between the thermal head 5 and the linerless label paper 11 can be avoided. Note that the same effect can be achieved by rendering a recessed part 67 as shown in FIG. 4C instead of the through-hole 66.

Furthermore, because the heat sink 6 has a guide surface 63 for guiding the platen roller 8, the platen roller 8 will not directly contact the corner (downstream edge 54*a*) of the downstream end 54 of the thermal head 6 with the linerless label paper 11 therebetween when the cover 4 is closed.

Figure 5A:
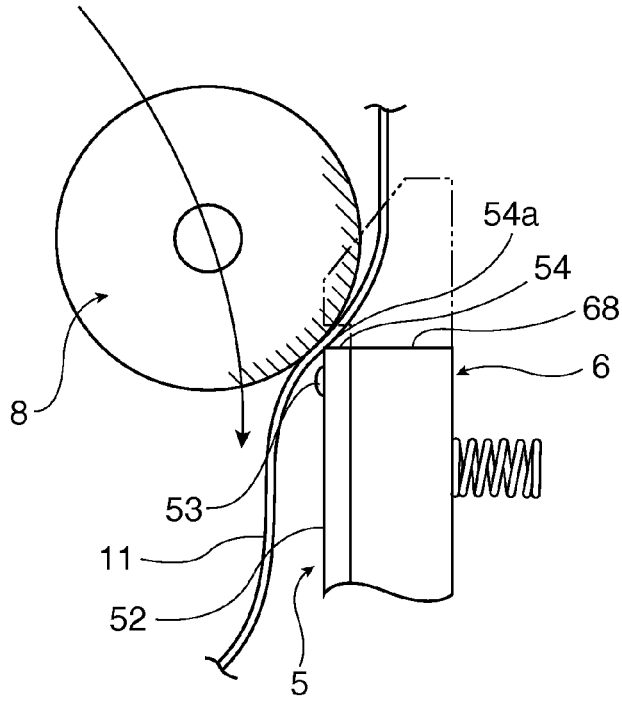
FIG. 5 describes the operating effect of the guide surface of the heat sink.

As shown in FIG. 5A, when the guide surface 63 is not rendered to the heat sink 6 and the downstream end 68 is positioned substantially flush with the downstream end 54 of the thermal head 5, the platen roller 8 directly contacts the corner (54*a*) of the downstream end 54 of the thermal head 5 when the cover 4 closes. Because the platen roller 8 must be pushed passed this corner (54*a*) and against the surface 52, great force is required to close the cover 4. There is also the possibility of linerless label paper 11 damage caused by the linerless label paper 11 being pinched between the platen roller 8 and this corner (54*a*).

Figure 5B:
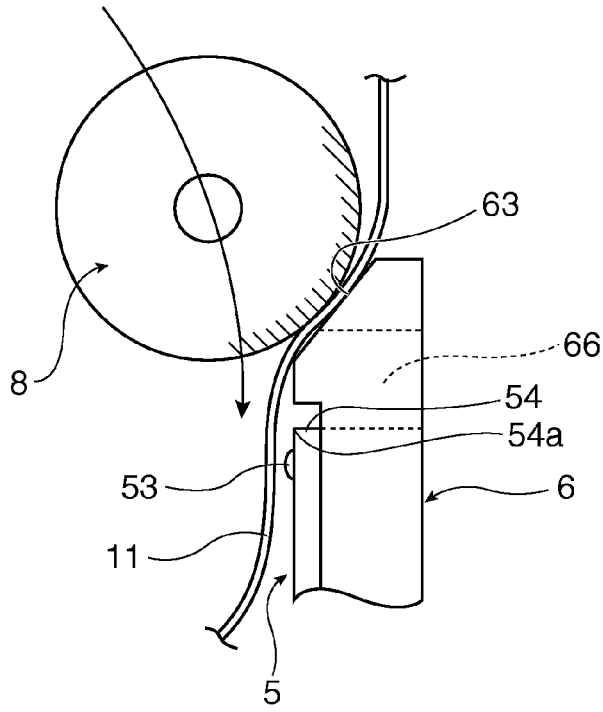

By rendering a guide surface 63 as described in this embodiment of at least one embodiment of the invention, however, the platen roller 8 is guided by the guide surface 63 as shown in FIG. 5B and then pressed against the surface 52 of the thermal head 5. As a result, the platen roller 8 can be smoothly pressed into position, little strength is needed to close the cover 4, and the linerless label paper 11 will not be damaged by contact with the corner (54*a*).

Surface Processing the Downstream End of the Thermal Head

When foreign matter adheres to the downstream end 54 of the thermal head 5, the foreign matter 20 is fed into the through-hole 66 or the recessed part 67 of the heat sink 6 behind the thermal head 5. Therefore, the surface of the downstream end 54 is preferably treated to prevent foreign matter from adhering so that any foreign matter on the downstream end 54 is quickly fed into the through-hole 66 or the recessed part 67 on the back side. A glass coating or plastic coating may be applied, for example.

Figure 6A:
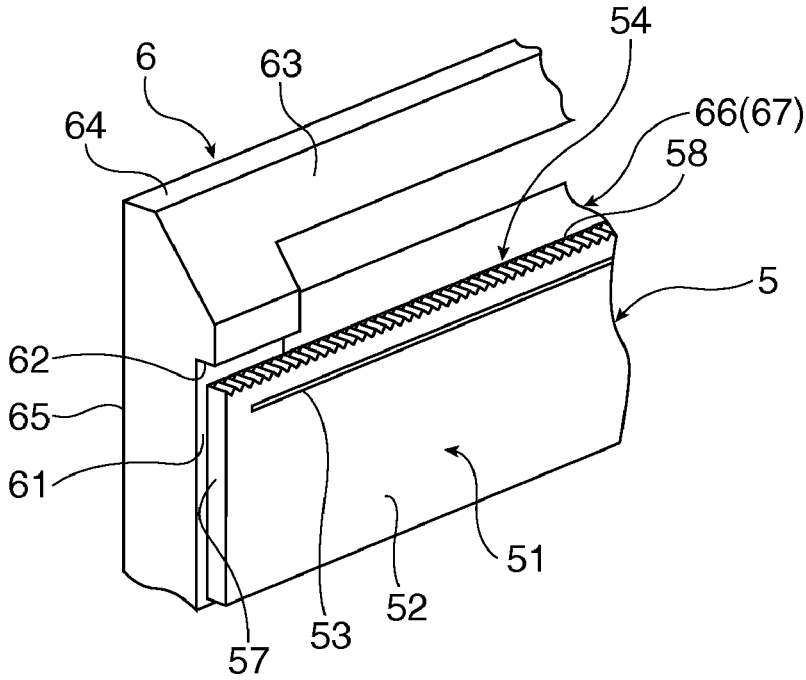
FIG. 6 shows an example of the surface process applied to the downstream side end of the thermal head.
Figure 6B:
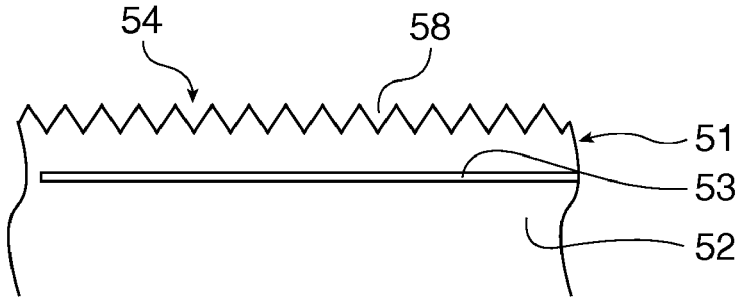

FIG. 6A and FIG. 6B show one example of the surface treatment given to the downstream end 54 of the thermal head 5. In this example a plurality of V grooves 58 or protrusions are formed at a constant pitch across the printing width on the downstream end 54 of the thermal head 5. The V grooves 58 extend parallel to each other from the front surface 52 to the back 57 of the thermal head 5. By thus forming the V grooves 58, adhesive or other foreign matter can move easily through the V grooves 58 into the through-hole 66 or recessed part 67 therebehind, and can be reliably prevented from accumulating on the downstream end 54.

Channels that have a rectangular section or other shape may be formed instead of V grooves 58. The depth, pitch, and other aspects of the grooves may also be suitably determined according to the particular implementation. The V grooves 58 may also be formed on the surface 66*a* of the through-hole 66 in the heat sink 6 on the upstream side in the paper transportation direction. This enables foreign matter to move smoothly through the V grooves 58 from the front to the back of the through-hole 66.

Figure 7A:
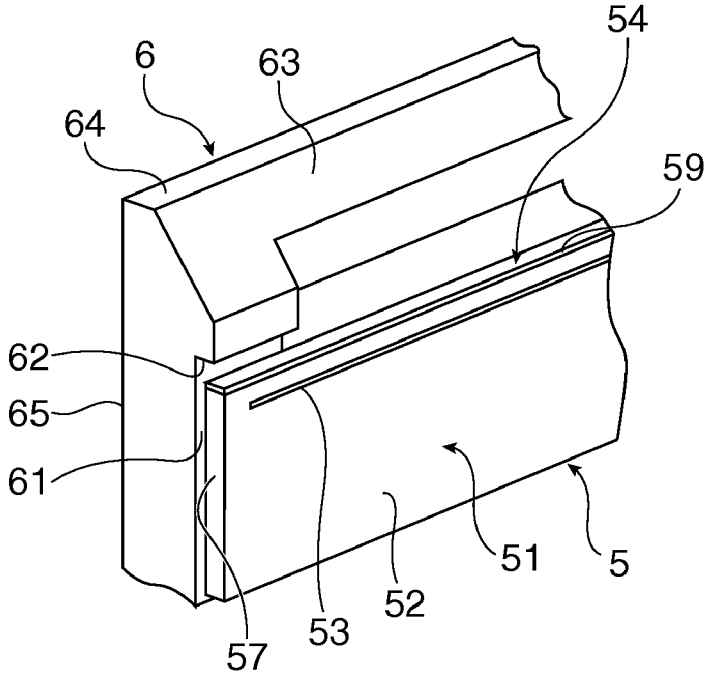
FIG. 7 shows an example of the surface process applied to the downstream side end of the thermal head.
Figure 7B:
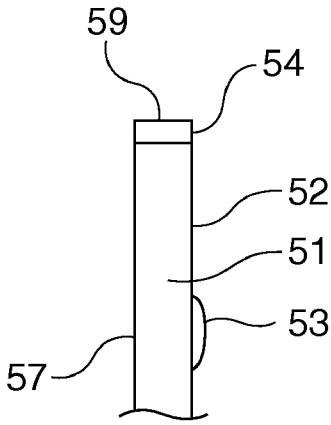

FIG. 7A and FIG. 7B show another example of the surface treatment given to the downstream end 54 of the thermal head 5. In this example a non-stick coating 59 is applied to the downstream end 54 of the thermal head 5. This coating may be rendered using a material with less attraction to adhesive than the substrate 51 of the thermal head 5. A glass coating or plastic coating may be applied, for example. A similar coating 59 may also be applied to the surface 66*a* of the through-hole 66 in the heat sink 6 on the upstream side in the paper transportation direction. This enables foreign matter to move smoothly from the front to the back of the through-hole 66.

The configurations shown in FIG. 6 and FIG. 7 may also be used together. More specifically, grooves such as the V grooves 58 may be formed in the downstream end 54 of the thermal head 5, and the surfaces of the grooves may be coated with an adhesive-resistant coating 59.

At least one embodiment of the invention having being thus described, it will be apparent to those skilled in the art that it may be varied or modified in numerous ways. Any such variation or modification is intended to be within the spirit and scope of the invention to the extent it falls within the scope of any of the following claims.

What is claimed is:

1. A thermal printer, comprising:

a thermal head;

a mounting member, including a mounting surface, to which the thermal head is disposed;

a platen roller for conveying while pressing a recording medium against the thermal head; and a foreign matter receptacle formed receding from the mounting surface of the mounting member on a downstream side, relative to the direction in which the recording medium is transported, of a recording medium nipping area formed between the thermal head and the platen roller.

2. The thermal printer described in claim 1, wherein the nipping area is greater than the width in the recording medium transportation direction of a heating unit disposed to the thermal head.

3. The thermal printer described in claim 1, wherein a downstream end of the thermal head is substantially flush with the downstream end of the nipping area.

4. The thermal printer described in claim 1, wherein the foreign matter receptacle is positioned proximally to the downstream end of the thermal head.

5. A thermal printer, comprising:

a thermal head;

a mounting member to which the thermal head is disposed;

a platen roller for conveying while pressing a recording medium against the thermal head; and a foreign matter receptacle formed receding from the thermal head mounting surface of the mounting member on a downstream side, relative to the direction in which the recording medium is transported, of a nipping area formed between the thermal head and the platen roller, the foreign matter receptacle being a through-hole or recessed part extending widthwise with respect to the recording medium.

6. The thermal printer described in claim 5, wherein an upstream side of the through-hole or recessed part is positioned on an extension of the downstream end of the thermal head.

7. The thermal printer described in claim 5, further comprising a printer frame, and wherein:

the mounting member has a guide surface for guiding the platen roller, the guide surface being formed at a position downstream of the through-hole or recessed part and inclining in the direction receding from a front surface of the guide surface to its downstream side;

the thermal head is disposed to the printer frame; and the platen roller is disposed to a cover that is attached to open and close to the printer frame.

8. The thermal printer described in claim 5, wherein grooves are formed from the front to the back of the thermal head on at least one of the downstream end of the thermal head and the upstream side of the through-hole or recessed part.

9. The thermal printer described in claim 5, wherein a coating is applied to at least one of the downstream end of the thermal head and the upstream side of the through-hole or recessed part.

* * * * *